US008061066B2

(12) United States Patent
Hong et al.

(10) Patent No.: US 8,061,066 B2
(45) Date of Patent: Nov. 22, 2011

(54) GARMENT REFRESHING APPARATUS

(75) Inventors: Sog Kie Hong, Seoul (KR); Dong Won Kim, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 322 days.

(21) Appl. No.: 12/300,860

(22) PCT Filed: May 9, 2007

(86) PCT No.: PCT/KR2007/002280

§ 371 (c)(1),
(2), (4) Date: Nov. 14, 2008

(87) PCT Pub. No.: WO2007/133004

PCT Pub. Date: Nov. 22, 2007

(65) Prior Publication Data

US 2009/0119955 A1 May 14, 2009

(30) Foreign Application Priority Data

May 15, 2006 (KR) ..... 10-2006-0043492

(51) Int. Cl.
*D06F 58/10* (2006.01)
*D06F 58/26* (2006.01)

(52) U.S. Cl. ..... 38/14; 38/1 A

(58) Field of Classification Search ..... 38/1 R, 38/3, 14, 1 A; 68/222; 223/70, 73
See application file for complete search history.

(56) References Cited

U.S. PATENT DOCUMENTS

| | | | | |
|---|---|---|---|---|
| 2,140,961 | A | 12/1938 | Lendle | |
| 3,601,292 | A * | 8/1971 | Bliss | 68/6 |
| 3,752,373 | A * | 8/1973 | Smith | 223/51 |
| 3,765,580 | A * | 10/1973 | Wilsker et al. | 223/52 |
| 3,849,815 | A * | 11/1974 | Frauendorf | 8/149.1 |
| 5,094,020 | A | 3/1992 | Wingfield et al. | |
| 5,592,750 | A * | 1/1997 | Eichten | 34/104 |
| 5,687,278 | A * | 11/1997 | Turner | 392/406 |
| 2001/0037590 | A1 | 11/2001 | MacGregor et al. | 38/3 |
| 2003/0050214 | A1 | 3/2003 | Scheper et al. | 510/421 |

FOREIGN PATENT DOCUMENTS

| | | |
|---|---|---|
| KR | 10-2004-0015957 A | 2/2004 |
| WO | WO 2006/091057 | 8/2006 |

OTHER PUBLICATIONS

International Search Report dated Aug. 20, 2007.
German Office Action dated Jun. 29, 2011 with English translation.

* cited by examiner

*Primary Examiner* — Ismael Izaguirre
(74) *Attorney, Agent, or Firm* — KED & Associates LLP

(57) ABSTRACT

A garment refreshing apparatus is provided. The garment refreshing apparatus includes a case, a steam generator, and a discharging device. The case stores garments. The steam generator supplies steam to the inside of the case. The discharging device is extendably connected to the steam generator, to discharge steam generated by the steam generator to the inside of the case.

18 Claims, 9 Drawing Sheets

[Fig. 1]
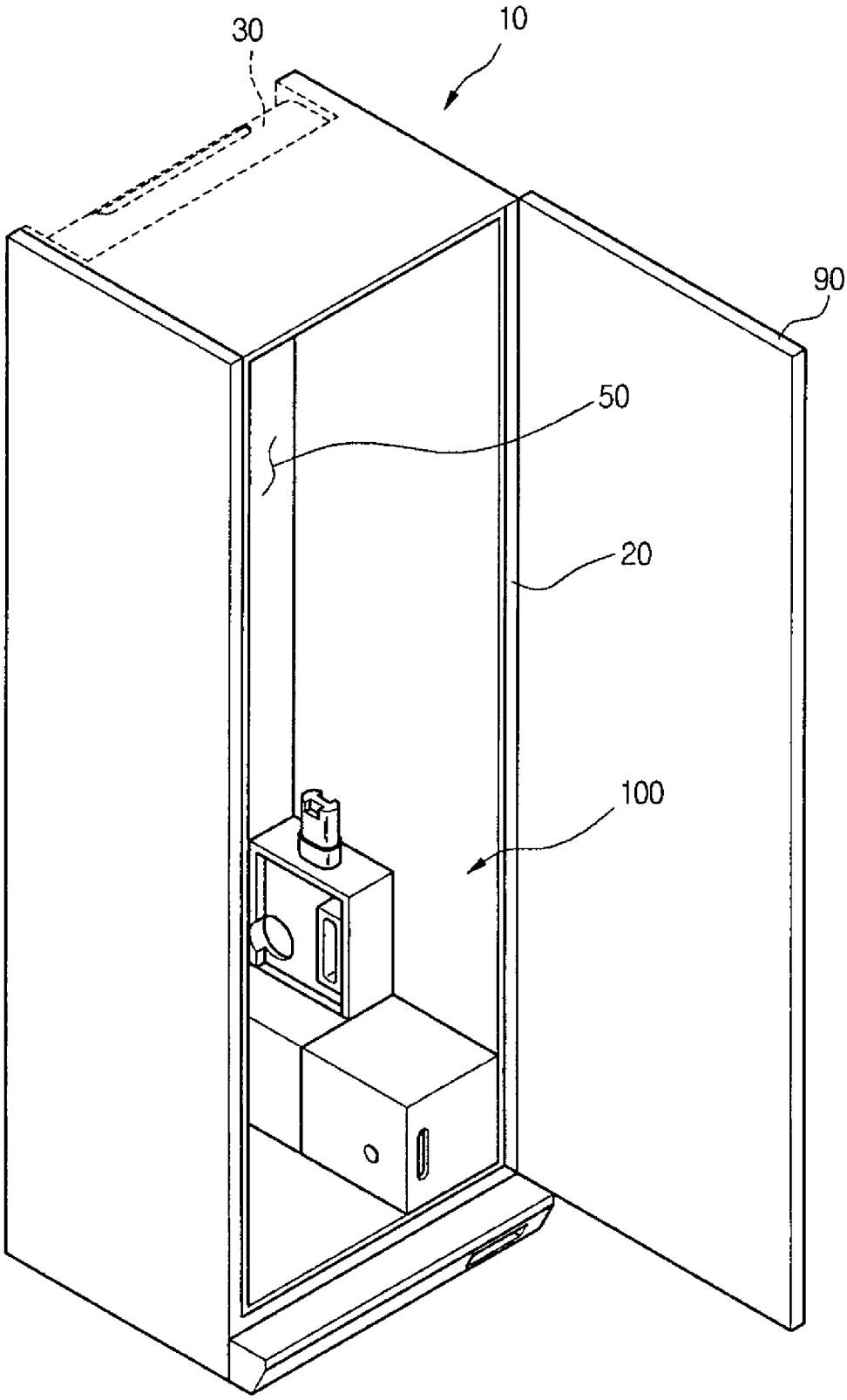

[Fig. 2]
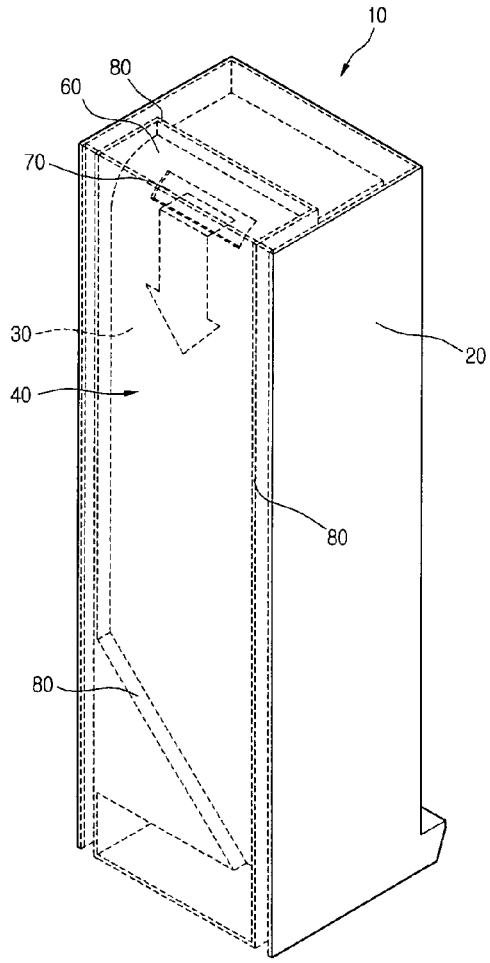
[Fig. 3]
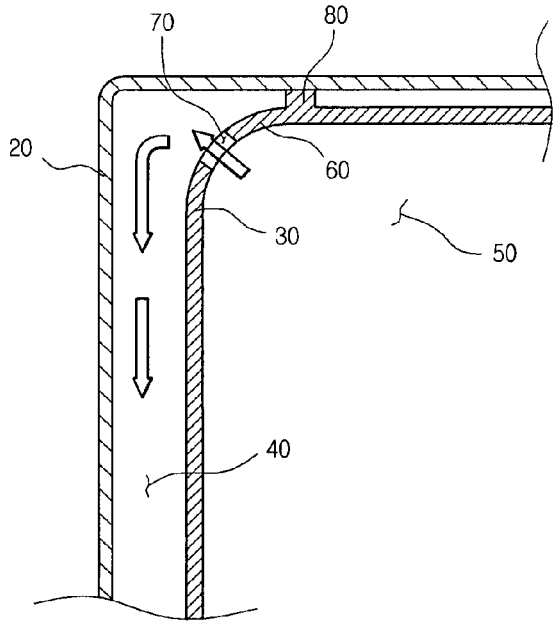

[Fig. 4]
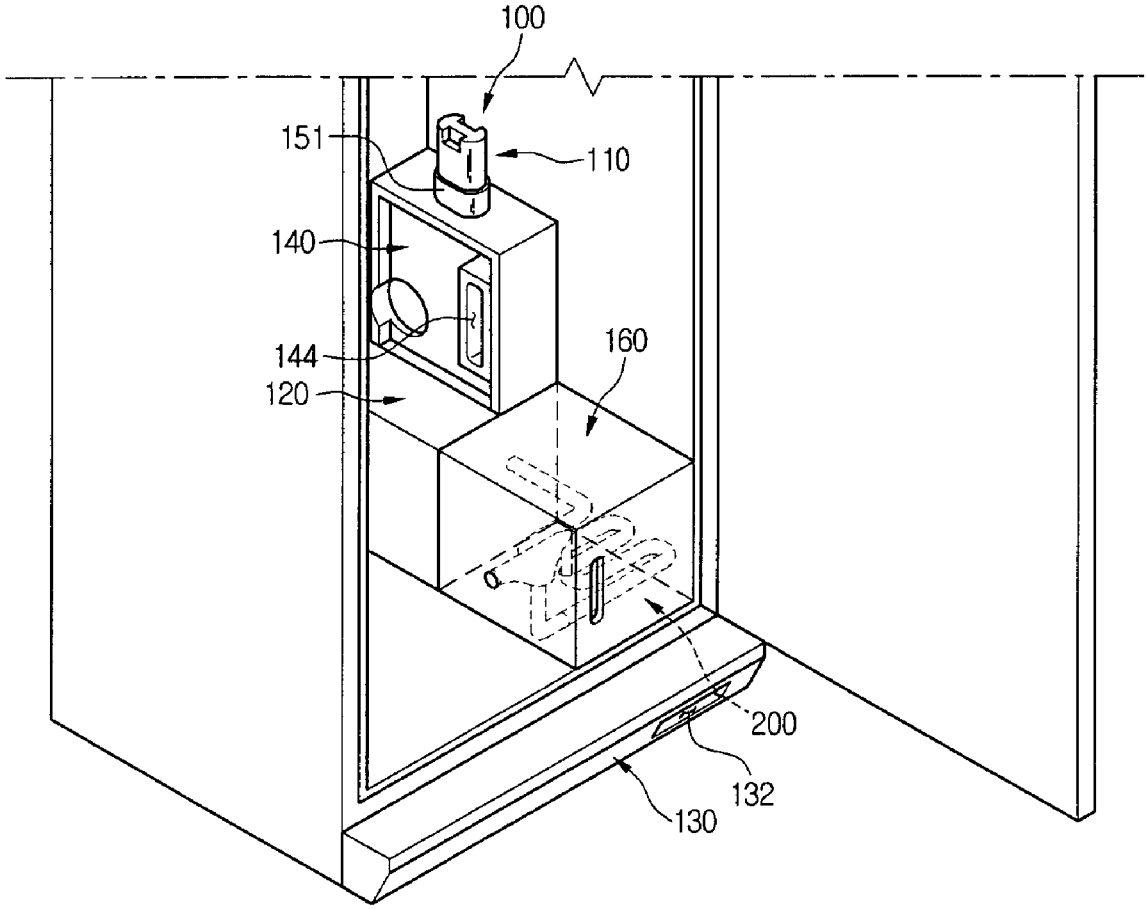

[Fig. 5]
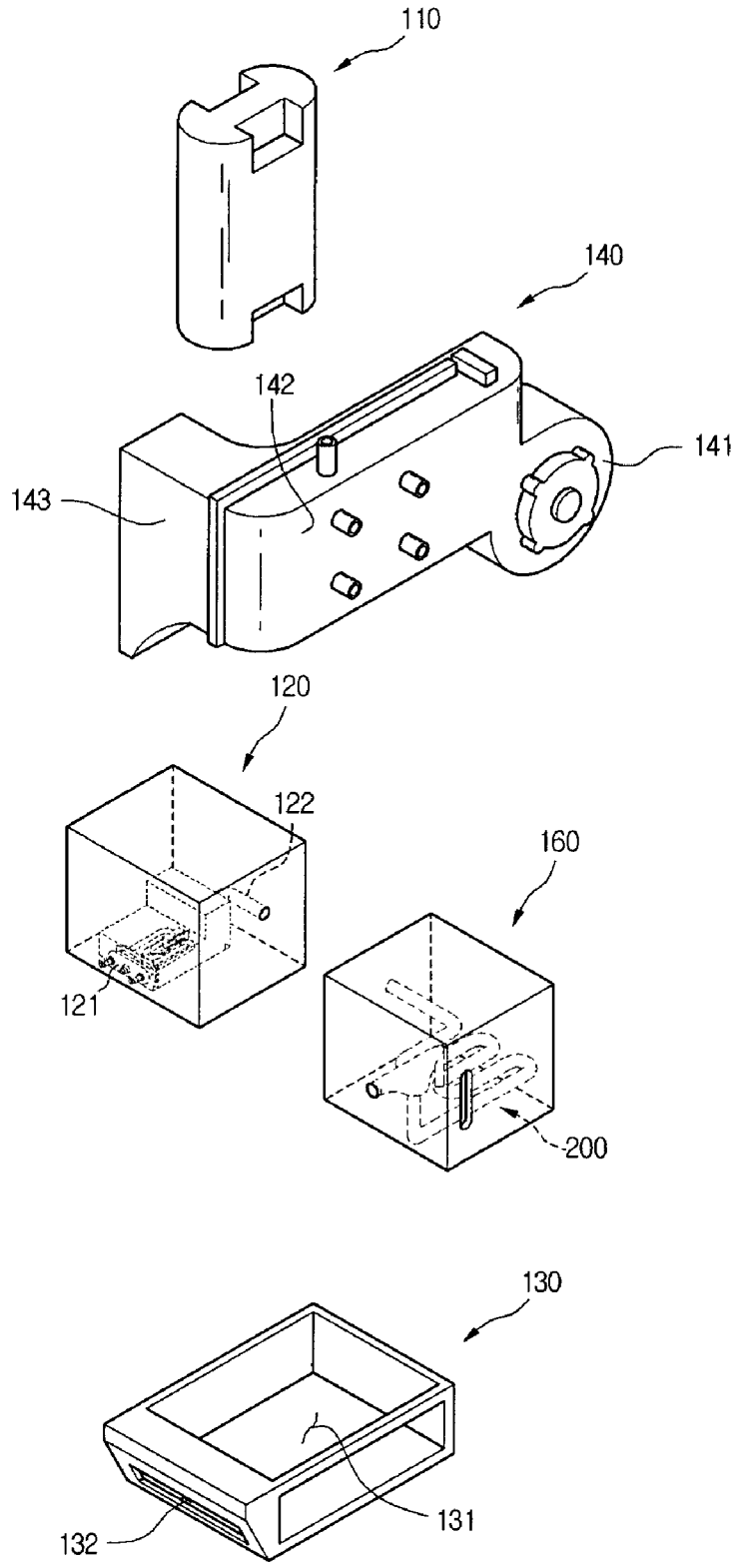

[Fig. 6]
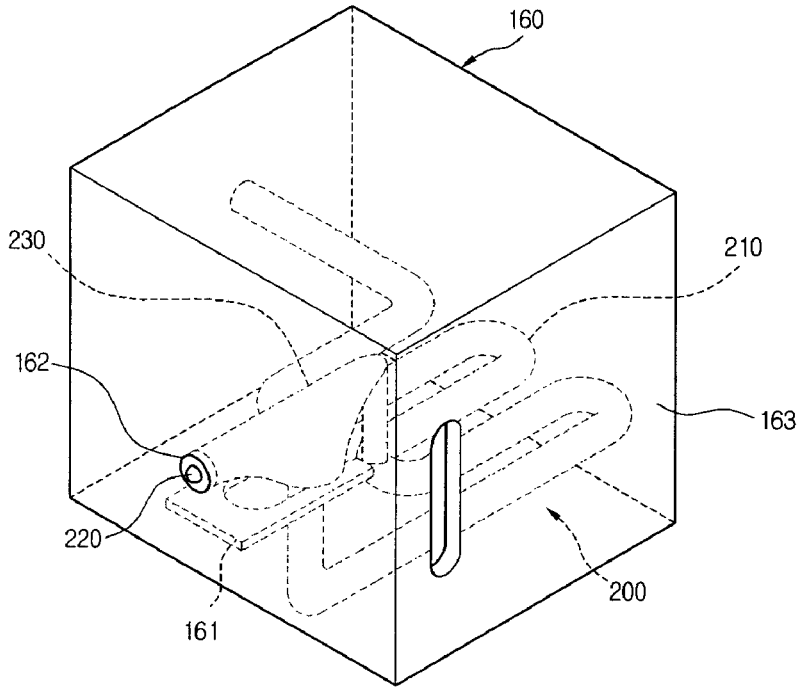
[Fig. 7]
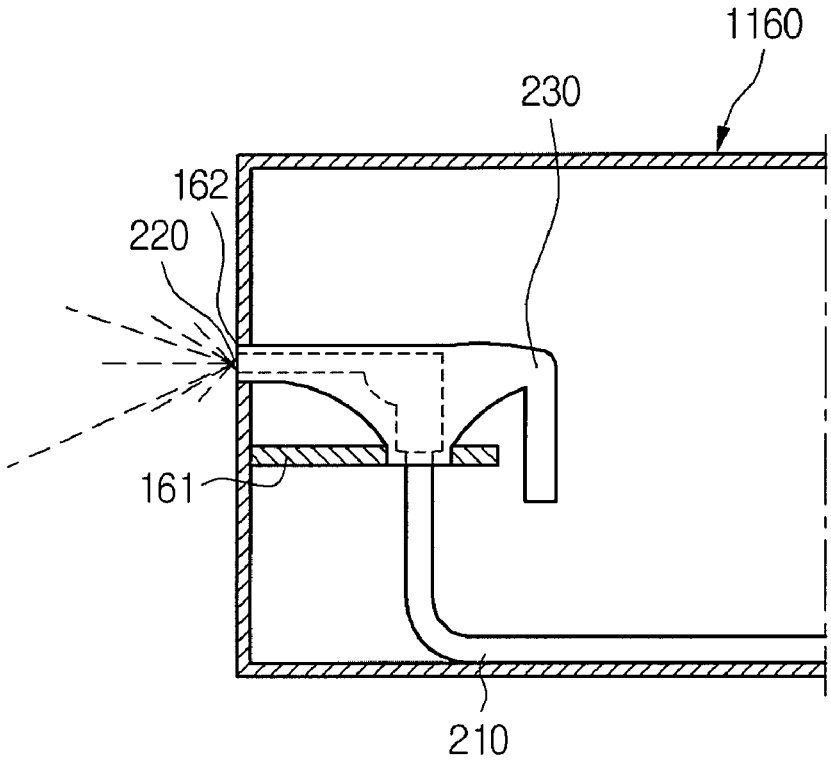

[Fig. 8]
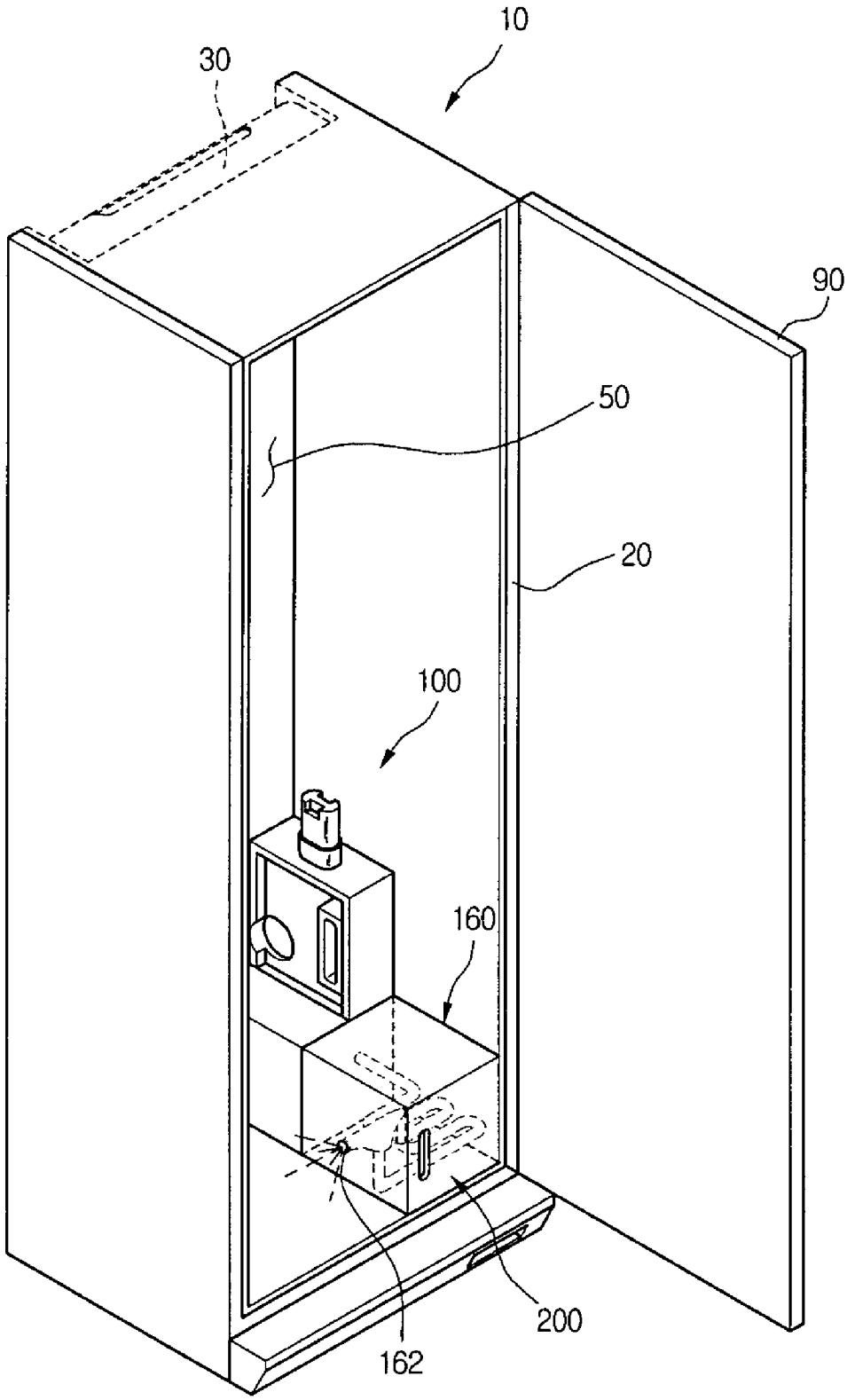

[Fig. 9]
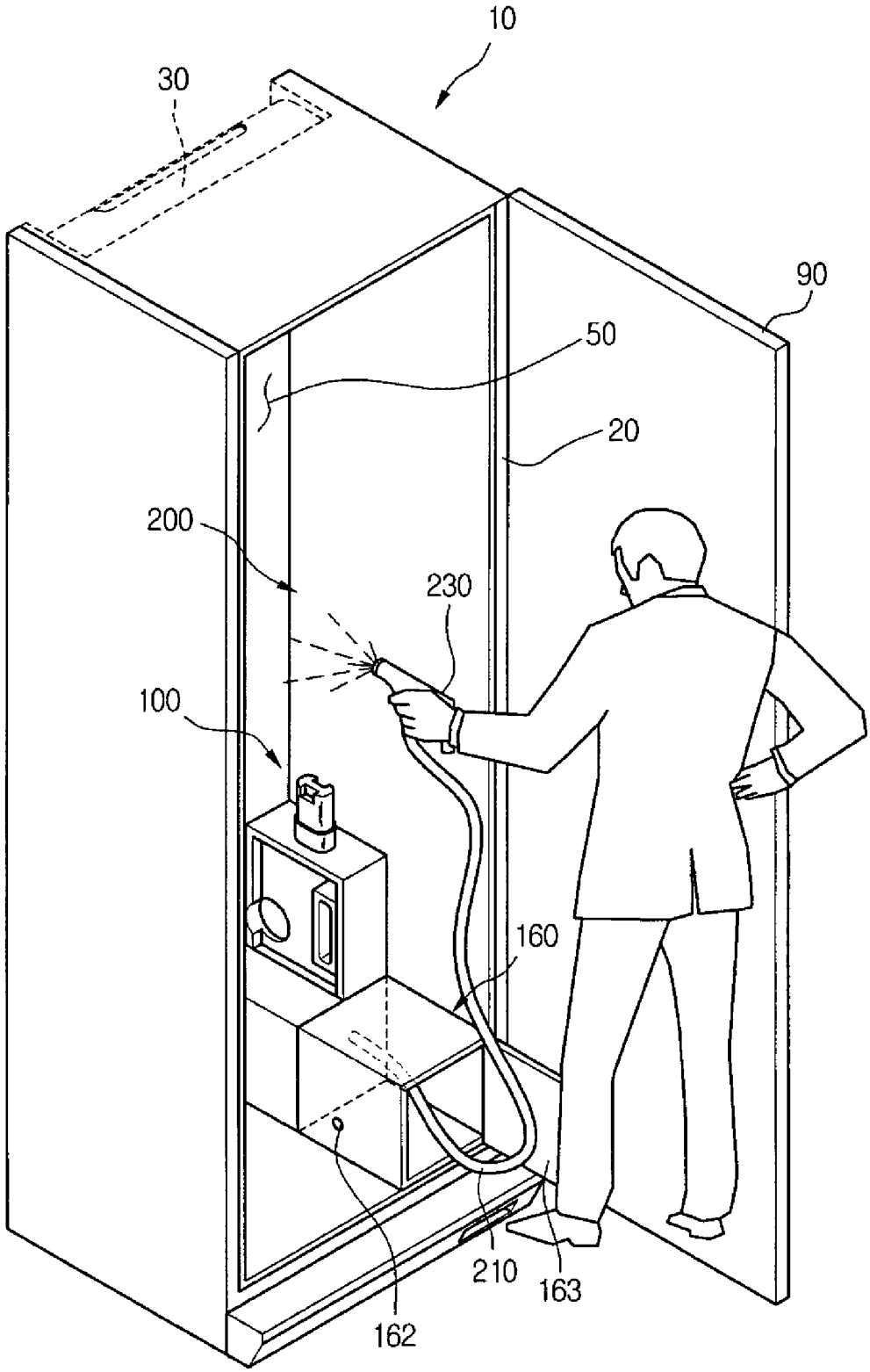

[Fig. 10]
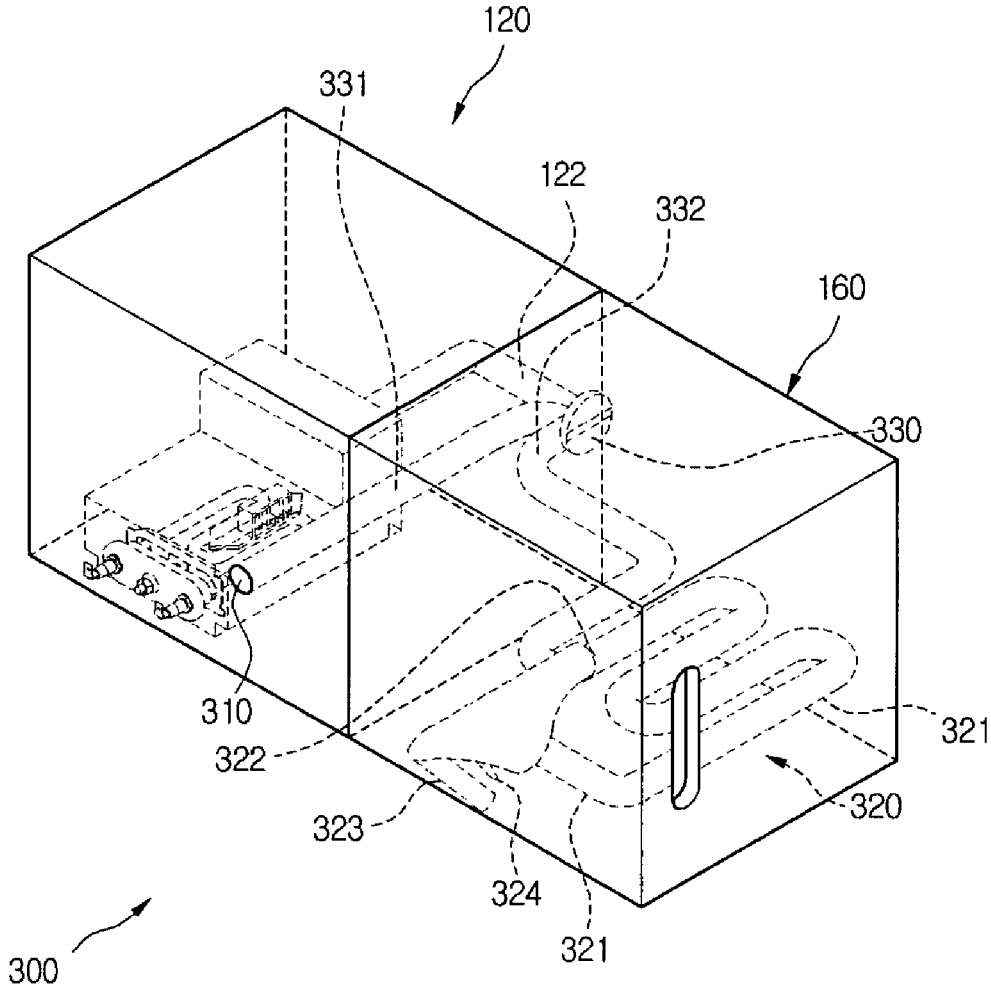

[Fig. 11]
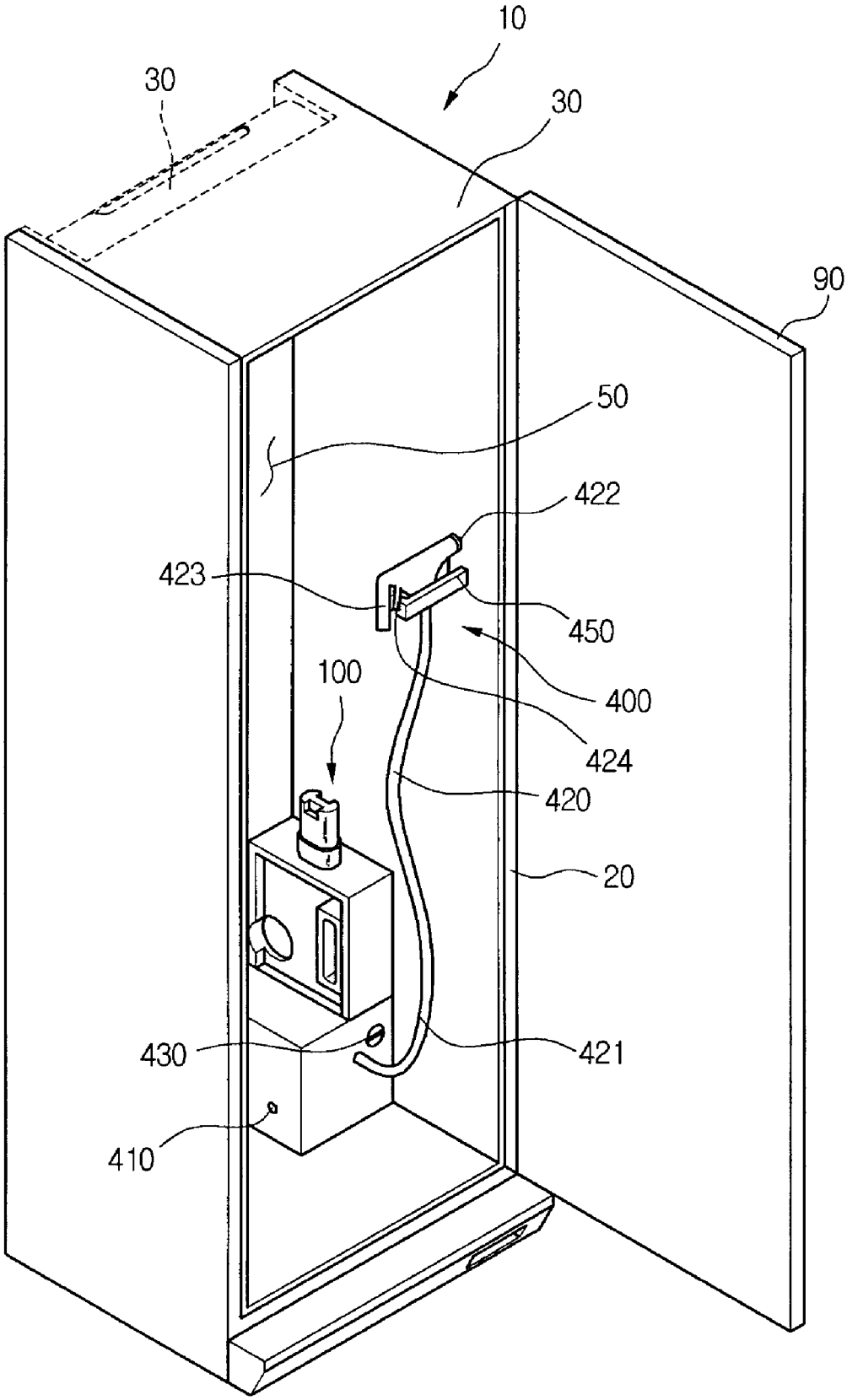

GARMENT REFRESHING APPARATUS

TECHNICAL FIELD

The present invention relates to a garment refreshing apparatus.

BACKGROUND ART

A garment refreshing apparatus is a home appliance that stores garments inside, and refreshes garments by removing odors and wrinkles therefrom.

Specifically, a garment refreshing apparatus uses steam and heat to perform straightening of creases and/or removal of odors from the clothes. Garments that are stored within the garment refreshing apparatus are deodorized by the removal of imbedded odor particles, or the removal of wrinkles (producing effects similar to ironing).

Garment refreshing apparatuses can be largely divided into condenser-type and exhaust-type apparatuses, depending on the refreshing method used. That is, a condenser-type apparatus circulates steam supplied for refreshing garments within the refreshing apparatus, and an exhaust-type apparatus exhausts steam out from the garment refreshing apparatus after the steam has refreshed the garments.

A garment refreshing apparatus includes an inner case forming a garment storage compartment, and a steam generator for generating steam. A heater is further installed on the steam generator. A separate water supplying line or a water tank for supplying water is connected to the steam generator. The water that is thus supplied is heated by the heater and converted to steam. The steam removes odor particles imbedded in garments stored within the storage compartment or straightens wrinkles in the garments.

However, in a garment refreshing apparatus according to the related art, a nozzle for discharging steam is fixed, so that the steam must necessarily be applied to the entirety of the storage compartment after garments are stored therein. Especially in the case of a small load of garments, having to apply steam to the entire inner compartment of the refreshing apparatus is a waste of energy resources.

Furthermore, when a user wishes to apply steam locally to only a particular portion of the garments, or steam needs to be applied only to one region of the garments, a user's options are limited because the apparatus is only able to apply steam to the entire interior of the garment refreshing apparatus.

DISCLOSURE OF INVENTION

Technical Problem

One object of the present invention is to provide a garment refreshing apparatus capable of increasing the level of user convenience by allowing a user to either store garments within the garment refreshing apparatus to apply steam to the garments, or to directly apply steam to specific regions of the garments.

Another object of the present invention is to provide a garment refreshing apparatus that allows a user to directly apply steam to garments (in cases where the quantity of garments to be refreshed is small), so that steam does not need to be applied to the entirety of the interior of the apparatus.

Technical Solution

According to an aspect of the present invention, there is provided a garment refreshing apparatus including: a case for storing garments; a steam generator for supplying steam to an inside of the case; and a discharging device extendably connected to the steam generator, for discharging steam generated by the steam generator to the inside of the case.

According to another aspect of the present invention, there is provided a garment refreshing apparatus including: a case opened at a side thereof; a door for opening and closing the opened side of the case; a steam generator contained within the case, for generating steam; a steam discharging portion extendably formed for allowing an adjusting of a discharged position of the steam generated by the steam generator; and a storage portion mounted to an inner side of the case, for storing the steam discharging portion.

According to a further aspect of the present invention, there is provided a garment refreshing apparatus including: a case forming a garment storage compartment; a steam generator installed on a side of the case, for supplying steam to the garment storage compartment; and a fixed nozzle and an extendable extended nozzle, for discharging the steam into the case.

According to a still further aspect of the present invention, there is provided a garment refreshing apparatus including: a case for storing garments; a steam generator for supplying steam into the case; and a discharging device for discharging the steam at garments stored within the case, wherein the discharging device is extendable in length for allowing a direct discharging of the steam at garments that a user requires to be refreshed.

Advantageous Effects

An advantage of the garment refreshing apparatus according to the present invention is that a user is not only able to store garments within the storage compartment to refresh the garments, but is also able to apply steam directly to specific regions of the garments, thereby increasing user convenience.

Another advantage of the garment refreshing apparatus according to the present invention is that it allows a user to directly apply steam to garments (in cases where the quantity of garments is small or only certain areas of the garments need to be refreshed), so that waste of energy resources is reduced and garments can be refreshed more quickly and simply.

BRIEF DESCRIPTION OF THE DRAWINGS

FIG. 1 is a perspective view of a garment refreshing apparatus according to the present invention.

FIG. 2 is a rear perspective view of a garment refreshing apparatus according to the present invention.

FIG. 3 is vertical sectional view schematically showing a condensing compartment and a steam inlet of a garment refreshing apparatus according to the present invention.

FIG. 4 is a perspective view showing a steam supplying device of a garment refreshing apparatus according to the present invention.

FIG. 5 is an exploded perspective view of the steam supplying device in FIG. 4.

FIG. 6 is a phantom perspective view of a discharging device of a garment refreshing apparatus according to the first embodiment of the present invention.

FIG. 7 is a schematic sectional view showing the discharging device in FIG. 6 fixed to a storage portion.

FIG. 8 is a schematic perspective view showing the discharging device of FIG. 6 fixed to a storage portion and discharging steam.

FIG. 9 is schematic perspective view showing the discharging device of FIG. 6 extended and discharging steam by means of a user.

FIG. 10 is a phantom perspective view of a discharging device of a garment refreshing apparatus according to the second embodiment of the present invention.

FIG. 11 is a perspective view of a discharging device of a garment refreshing apparatus according to the third embodiment of the present invention.

BEST MODE FOR CARRYING OUT THE INVENTION

Reference will now be made in detail to the preferred embodiments of the present invention, examples of which are illustrated in the accompanying drawings.

While a condenser-type apparatus is mainly described in the below detailed description according to embodiments of the present invention, the present invention is not limited hereto, and may be applied equally to an exhaust-type apparatus.

FIG. 1 is a perspective view of a garment refreshing apparatus according to the present invention.

Referring to FIG. 1, a garment refreshing apparatus 10 includes an outer case 20, an inner case 30 installed within the outer case 20, a garment storage compartment 50 that is an empty space within the inner case 30, a door 90 that a user can open and close, and a steam supplying device 100 formed at a lower side of the garment storage compartment 50.

In detail, the inner case 30 is formed slightly smaller by a predetermined amount than the outer case 20 in order to be installed in the outer case 20. Accordingly, when the inner case 30 is installed within the outer case 20, a predetermined gap can be formed between the outer wall of the inner case 30 and the inner wall of the outer case 20.

Also, when storing garments in the garment storage compartment 50, although not shown, a shelf for placing garments on or a hanger for hanging garments may be included.

The steam supplying device 100 generates steam and hot air, and supplies the same to the garment storage compartment 50. Also, a nozzle for discharging steam is extendable to a predetermined length, in order to allow direct application of steam to garments.

Thus, garments stored in the garment storage compartment 50 can be removed of wrinkles and contaminants through the use of steam, and may be dried by means of the generated hot air. Furthermore, a user can directly apply steam to garments to remove wrinkles and contaminants.

FIG. 2 is a rear perspective view of a garment refreshing apparatus according to the present invention, and FIG. 3 is vertical sectional view schematically showing a condensing compartment and a steam inlet of a garment refreshing apparatus according to the present invention.

Referring to FIGS. 2 and 3, a condensing compartment 40 is provided at the rear of the garment refreshing apparatus 10 in the space between the outer case 20 and the inner case 30. Also, a steam inlet forming portion 60 is formed at the upper rear portion of the inner case 20, and a steam inlet 70 is formed in the steam inlet forming portion 60. A steam blocking portion 80 is formed at the outer wall of the steam inlet forming portion 60.

In further detail, the steam inlet forming portion 60, as a sloped surface, is formed to gradually decline, and the steam inlet 70 is formed in the steam inlet forming portion 60. Accordingly, steam that has contacted garments within the garment storage compartment 50 is able to be expelled through the steam inlet 70 to the outside of the garment storage compartment 50. Here, because the steam has the property of rising in a vapor state, the steam inlet 70 may be formed at the top portion of the garment refreshing apparatus 10.

Also, the steam blocking portion 80 routes the steam flowing through the steam inlet 70 to the condensing compartment 40, thereby preventing the steam from flowing into the space between the outer case 20 and the inner case 30 that is not a part of the condensing compartment 40. This steam blocking portion 80 is formed to extend to edges of the outer case 20 and the inner case 30 forming the condensing compartment 40.

The condensing compartment 40 is a portion in which steam discharged through the steam inlet 70 descends and condenses. Because the steam is in a hot vapor state, the outer case 20 forming the condensing compartment 40 acts as a heat exchanging membrane to exchange heat between the lower temperature outside air and the steam to condense the steam. The outer case 20, in order to perform effective heat exchange of the steam, may be formed of a material such as steel or aluminum with a high heat transfer coefficient.

FIG. 4 is a perspective view showing a steam supplying device of a garment refreshing apparatus according to the present invention, and FIG. 5 is an exploded perspective view of the steam supplying device in FIG. 4.

Referring to FIGS. 4 and 5, the steam supplying device 100 includes a supply tank 110 for storing a predetermined quantity of water within, a steam generator 120 for receiving a supply of water from the supply tank 110 and generating steam, a drain tank 130 for collecting water remaining in the steam generator 120 and water that condenses in the condensing compartment 40, a drying duct 140 for suctioning air from the outside and heating the air and then supplying drying air into the garment storage compartment 50, a discharging device 200 for discharging the steam generated by the steam generator 120, and a storage portion 160 for storing the discharging device 200.

The supplying tank 110 supplies water to the steam generator 120, and is detachably coupled to a water tank coupling portion 151. Thus, when water stored inside the supplying tank 110 is used up, the supply tank 110 can be easily detached to refill it.

The steam generator 120 generates steam from the supplied water through a built-in heater 121, and the generated steam is supplied to the discharging device 200 through a predetermined supplying pipe 122.

The drain tank 130 includes a collecting space 131 for collecting water remaining in the steam generator 120 and water that condenses in the condensing compartment 40, and a draining passage connected to the steam generator 120 and the condensing compartment 40. Also, the drain tank 130 is detachably installed to the lower portion of the body of the garment refreshing apparatus 10.

The drain tank 130 may be installed in a shelf configuration at the bottom of the body of the garment refreshing apparatus 10, and in this case, a grasping recess 132 for a user to insert a hand into and pull out the shelf may be formed therein.

Accordingly, when the amount of water collected in the collecting space 131 reaches a saturated level, or water remains stale in the drain tank 130 for a predetermined duration so that the growth of bacteria is likely, a user can insert his/her hand in the grasping recess 132 to easily pull out the drain tank 130 and empty it.

In addition, the drying duct 140 includes a fan housing 141 for installing the fan within, a heater housing 142 for installing the heater within, a discharging portion 143 for discharging the air that passes through the heater housing 142 to the garment storage compartment 50, and a discharge port 144 for discharging the heated air. The drying duct 140 functions to heat and circulate air within the garment storage compartment 50.

Therefore, the outside air may be induced to flow in by means of the fan, and the influx of the air may be heated by the heater and converted to a hot flow of air, so that the converted hot air flows along the discharging portion 143 and through the discharge port 144 into the garment storage compartment 50. Thus, the garments stored inside the garment storage compartment 50 are dried by means of the hot airflow.

The discharging device 200 either supplies steam into the garment storage compartment 50 or is formed to extend to a predetermined range to discharge steam therefrom. Therefore, a user can selectively store garments in the garment storage compartment 50 to refresh the garments, or refresh the garments by directly applying steam thereto.

The refreshing operation of a garment refreshing apparatus according to the present invention will be described below. However, the operation described below is only exemplarily provided, and a variety of alternate procedural steps are possible according to the present invention.

First, when garments are stored in the garment storage compartment 50, power is applied to the drying fan, so that outside air enters the drying duct 140. The air that flows into the drying duct 140 is heated therein and converted to hot air, after which it is discharged through the discharge port 144. In this way, the discharged hot air dries garments stored in the garment storage compartment 50.

Next, the water in the supplying tank 110 in the steam supplying device 100 is supplied to the steam generator 120. The supplied water is heated by the heater 121 in the steam generator 120 and converted to hot steam, and is supplied to the discharging device 200. The steam may pass through the discharging device 200 into the garment storage compartment 50 to be applied to the garments stored therein.

The steam that has been applied to the garments passes through the steam inlet 70 and enters the condensing compartment 40. The steam that enters the condensing compartment 40 passes therethrough, whereupon the rear surface of the outer case 20 acts as a heat exchanging membrane that performs heat exchanging between the steam and outside air, so that the steam condenses and is converted into condensed water.

The thus formed condensed water flows along the walls of the inner case 30 and the outer case 20 that form the condensing compartment 40. The condensed water that flows along the walls enters the draining tank 130 through a predetermined passage. After the supplying of steam has been completed, water that remains in the steam generator 120 may flow into the draining tank 130 through a predetermined passage. Then, by emptying the draining tank 130, the water that has entered the draining tank 230 may be removed from the garment refreshing apparatus 100.

After outside air has entered through the drying duct 140 to be converted into hot air, as described above, the air is applied to the garments stored in the garment storage compartment 50.

By performing the above process, the garments stored in the garment storage compartment 50 may be removed of contaminants and wrinkles so that results similar to ironing can be realized.

When the user wishes to directly apply steam to the garments, the discharging device 200 may be extended to a predetermined position on the garments to apply steam directly thereto. In this case, the hot air may be supplied from the drying duct 140 to directly apply it to the garments, or the supply of hot air may be stopped.

FIG. 6 is a phantom perspective view of a discharging device of a garment refreshing apparatus according to the first embodiment of the present invention, and FIG. 7 is a schematic sectional view showing the discharging device in FIG. 6 fixed to a storage portion.

Referring to FIGS. 6 and 7, the discharging device 200 includes an extension 210 connected to the supplying pipe 122, and a nozzle 220 coupled to the end of the extension 210 to discharge steam.

In detail, in order to extend the extension 210 a predetermined length, it may be formed of a pipe or a hose having a predetermined length, and a handle 230 may further be formed to enclose the nozzle 220 at the end of the extension 210. Accordingly, a user may grasp the handle 230 of the discharging device 200 and extend the extension 210 to a predetermined position in order to directly apply steam to garments.

In this way, in cases where only certain portions of garments are wrinkled or are contaminated with food deposits, etc., a user may apply steam to only that particular portion, so that garments may be refreshed more easily and quickly.

While the extension 210 is embodied as a pipe or a hose with a predetermined length in the present embodiment, it may alternately be embodied as a corrugated-type expandable hose. That is, the extension 210 may be embodied in a variety of alternate forms that are capable of being extended and adjusted by a user to various positions to discharge steam.

The storage portion 160 includes an attaching portion 161 that allows the nozzle 220 to be fixed on or detached therefrom, a nozzle hole 162 for allowing steam discharged from the nozzle 220 to be supplied into the garment storage compartment 50, and a door 163 for allowing a user to open or close the storage portion 160.

Accordingly, when the nozzle 220 is fixed to the attaching portion 161 to discharge steam, the steam is supplied through the nozzle hole 162 into the garment storage compartment 50. When a user wishes to directly apply steam to a predetermined region of garments, the user may open the door 163 and remove the nozzle 220 from the attaching portion 161 to directly apply the steam.

In order to easily attach the nozzle 220 to the attaching portion 161, the attaching portion may be formed in a shape corresponding to the nozzle 220. The attaching portion 161 is disposed so that when the discharging device 200 is mounted on the attaching portion 161, the discharge port of the nozzle 220 can protrude through the nozzle hole 162 formed in the storage portion 160.

Thus, the nozzle 220 is fixed to the attaching portion 161 in the storage portion 160, so that when steam is discharged, the steam is not discharged within the storage portion 160 and can be discharged directly into the garment storage compartment 50.

FIG. 8 is a schematic perspective view showing the discharging device of FIG. 6 fixed to a storage portion and discharging steam, and FIG. 9 is schematic perspective view showing the discharging device of FIG. 6 extended and discharging steam by means of a user.

Referring to FIGS. 8 and 9, when steam is discharged into the garment storage compartment 50, the discharging device 200 is coupled and fixed to the attaching portion 161 formed in the storage portion 160. The steam passes through the nozzle hole 162 and is discharged into the garment storage compartment 50.

When a user wishes to apply steam directly to a certain portion of garments, the user opens the door 163 of the storage portion 160, and disengages the discharging device 200 from the attaching portion 161, after which the discharging device 200 is extended to a certain length. Thus, the user is able to directly apply steam to garments without having to store the garments inside the garment storage compartment 50.

As described above in exemplary embodiments according to the present invention, a user is able to not only discharge steam at garments after storing the garments in the garment storage compartment 50, but is also able to directly apply steam to a pre-determined region of the garments to refresh the garments. User convenience increases because users are given this choice.

Moreover, in cases where the quantity of garments to be refreshed is small or where only a certain area of a garment needs to be refreshed, waste of energy resources can be reduced, and garments can be refreshed more quickly and easily by not having to apply steam to the entire inside of the garment storage compartment 50.

FIG. 10 is a phantom perspective view of a discharging device of a garment refreshing apparatus according to the second embodiment of the present invention.

Referring to FIG. 10, a discharging device 300 according to the present embodiment includes a fixed nozzle 310 that discharges steam in a fixed position, an extended nozzle 320 extended to a predetermined position to discharge steam, and a damper 330 that allows a user to switch the supplying of steam generated by the steam generator 120 to the fixed nozzle 310 or the extended nozzle 320.

Specifically, the fixed nozzle 310 is fixedly installed in the steam generator 120, and receives a supply of steam generated from the steam generator 120 through the damper 330 and a first supply pipe 331. The fixed nozzle 310 may also be formed as a pre-determined discharging port.

Thus, when the quantity of garments to be refreshed is large, a user stores the garments inside the garment storage compartment 50 to be refreshed. In this case, the user manipulates the damper 330 so that steam is supplied to the fixed nozzle 310, while closing the door 90 of the refreshing apparatus 10 in order to seal the garment storage compartment 50. By thus automatically refreshing garments, a large quantity of garments can be easily refreshed.

The extended nozzle 320 is stored on an attaching portion 160 installed on one side of the steam generator 120, so that the steam generated by the steam generator 120 can be supplied to the extended nozzle 320 through the damper 330 and a second supply pipe 332.

In further detail, the extended nozzle 320 includes an extended portion 321 extending to a predetermined position, a nozzle 322 for discharging steam, and a handle 323 formed around the nozzle 322.

Therefore, a user is able to adjust the position from which steam is discharged to a desired position, for refreshing a small load of garments or certain regions of the garments. Here, the user manipulates the damper 330 so that steam is supplied to the extended nozzle 320, and extends the extended nozzle 320 to a predetermined position in order to directly direct the discharge of steam on the garments, thereby refreshing a small load of garments or a certain region of the garments.

In order for a user to adjust the discharge of steam from the extended nozzle 320, a controller 324 may be further formed on the extended nozzle 320. The nozzle 322 may be formed such that it opens to discharge steam when the user pulls the controller 324, and the nozzle 322 closes when the controller 324 is not pulled.

Thus, when a user wishes to directly apply steam to garments, the discharging of steam can easily be controlled, raising the level of user convenience.

The damper 330 may be configured to either supply steam to only one of the fixed nozzle 310 and the extended nozzle 320, or to supply both the fixed nozzle 310 and the extended nozzle 320 with steam, when manipulated by a user.

Therefore, a user can store garments in the garment storage compartment 50 to refresh the garments, and simultaneously apply steam to refresh the garments for a quicker refreshing of the garments.

FIG. 11 is a perspective view of a discharging device of a garment refreshing apparatus according to the third embodiment of the present invention.

In the third embodiment of a discharging device, when compared to the second embodiment of the present invention, the discharging device is removed of the storage portion 160, and has a mounting portion 450 formed on one side of the inner wall of the garment storage compartment 50. To differentiate from elements in the second embodiment the discharging device in the third embodiment is assigned reference number 400, and other elements are given reference numbers in the 400s as well.

Referring to FIG. 11, a garment refreshing apparatus 10 according to the current embodiment further includes a mounting portion 450 formed on one side surface inside the inner case 30 in order to hang the extended nozzle 420 thereon. Accordingly, a storage portion 160 that would otherwise be installed inside the garment storage compartment 50 can be removed, so that the space for storing garments inside the garment storage compartment 50 increases.

The mounting portion 450 may be installed at a height enabling easy access by a user. In this configuration, when a user wishes to apply steam directly to pre-determined regions of the garments, the user grasps the handle 423 formed on the extended nozzle 420.

In the above-configured garment refreshing apparatus according to the present invention, a user may selectively store garments in the garment storage compartment to refresh the garments, and also apply steam directly to specific regions on the garments, so that user convenience is increased.

Also, when the quantity of garments to be refreshed is small or only specific areas of the garments need to be refreshed, a user may directly apply steam to perform the garment refreshing, thereby reducing waste of energy resources and deriving a quick and simple refreshing of garments.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The garment refreshing apparatus according to the present invention not only enables a user to store garments within the storage compartment to refresh the garments, but also enables the user to apply steam directly to specific regions of the garments, for a high industrial applicability.

The invention claimed is:

1. A garment refreshing apparatus comprising:

a case for storing garments;

a steam generator for supplying steam to an inside of the case; and a discharging device extendably connected to the steam generator, for discharging steam generated by the steam generator to the inside of the case, wherein the discharging device is detachably mounted to an inner wall of the case.

2. The garment refreshing apparatus according to claim 1, wherein the discharging device is contained inside the case.

3. The garment refreshing apparatus according to claim 1, further comprising a storage portion for storing the discharging device.

4. The garment refreshing apparatus according to claim 3, wherein the storage portion includes an attaching portion for mounting the discharging device on.

5. The garment refreshing apparatus according to claim 3, wherein the storage portion defines a nozzle hole through which a nozzle of the discharging device is protruded.

6. A garment refreshing apparatus comprising:

a case opened at a side thereof;

a door for opening and closing the opened side of the case;

a steam generator contained within the case, for generating steam;

a steam discharging portion extendably formed for allowing a discharged position of the steam generated by the steam generator to be adjusted; and a storage portion mounted to an inner side of the case, for storing the steam discharging portion, wherein the steam discharging portion is detachably coupled to an inner side of the storage portion.

7. A garment refreshing apparatus, comprising:

a case opened at a side thereof;

a door for opening and closing the opened side of the case;

a steam generator contained within the case, for generating steam;

a steam discharging portion extendably formed for allowing a discharged position of the steam generated by the steam generator to be adjusted; and a storage portion mounted to an inner side of the case, for storing the steam discharging portion, wherein the steam discharging portion comprises a hose of a predetermined length and a nozzle coupled to an end of the hose.

8. A garment refreshing apparatus, comprising:

a case opened at a side thereof;

a door for opening and closing the opened side of the case;

a steam generator contained within the case, for generating steam;

a steam discharging portion extendably formed for allowing a discharged position of the steam generated by the steam generator to be adjusted; and a storage portion mounted to an inner side of the case, for storing the steam discharging portion, wherein the steam discharging portion comprises a contractable extended hose in a corrugated shape and a nozzle coupled to an end of the extended hose.

9. The garment refreshing apparatus according to claim 6, wherein the storage space is installed proximally to a side of the steam generator.

10. The garment refreshing apparatus according to claim 6, wherein the steam discharging portion is connected to a supply pipe of the steam generator.

11. The garment refreshing apparatus according to claim 6, wherein the storage portion defines a nozzle hole through which an end of a nozzle of the steam discharging portion is protruded.

12. The garment refreshing apparatus according to claim 6, wherein the case comprises a mounting portion provided on a side wall thereof, for mounting the steam discharging portion.

13. A garment refreshing apparatus comprising:

a case forming a garment storage compartment;

a steam generator installed on a side of the case, for supplying steam to the garment storage compartment;

a fixed nozzle and an extendable extended nozzle, for discharging the steam into the case; and a damper to control discharge of the steam from one of the fixed nozzle or the extended nozzle, or from both the fixed nozzle and the extended nozzle.

14. The garment refreshing apparatus according to claim 13, wherein the fixed nozzle is formed on the steam generator.

15. The garment refreshing apparatus according to claim 13, further comprising a storage portion for storing the extended nozzle.

16. The garment refreshing apparatus according to claim 15, further comprising a mounting portion for mounting the extended nozzle in the storage portion.

17. The garment refreshing apparatus according to claim 13, further comprising a mounting portion for mounting the extended nozzle on a side wall of the garment storage compartment.

18. A garment refreshing apparatus, comprising:

a case forming a garment storage compartment;

a steam generator, installed on a side of the case, to supply steam to the garment storage compartment; and a fixed nozzle and an extendable extended nozzle, for discharging the steam into the case, wherein the extended nozzle comprises a controller for controlling whether to discharge steam.

* * * * *